US009869214B2

(12) United States Patent
Berndt

(10) Patent No.: US 9,869,214 B2
(45) Date of Patent: Jan. 16, 2018

(54) MULTI-POSITIONAL CAMSHAFT PHASER WITH TWO ONE-WAY WEDGE CLUTCHES AND SPRING ACTUATOR

(71) Applicant: Schaeffler Technologies AG & Co. KG, Herzogenaurach (DE)

(72) Inventor: Eric Berndt, Whitefish Bay, WI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 175 days.

(21) Appl. No.: 14/978,821

(22) Filed: Dec. 22, 2015

(65) Prior Publication Data

US 2017/0175595 A1 Jun. 22, 2017

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/34406* (2013.01); *F01L 1/34409* (2013.01); *F01L 1/047* (2013.01); *F01L 2820/03* (2013.01); *F01L 2820/031* (2013.01)

(58) Field of Classification Search

CPC ... F01L 1/34406; F01L 1/34409; F01L 1/052; F01L 1/047; F01L 2820/031; F01L 2820/03

USPC ..... 123/90.15, 90.11, 90.17, 17

See application file for complete search history.

(56) References Cited

U.S. PATENT DOCUMENTS

| | | | | |
|---|---|---|---|---|
| 6,216,654 | B1 * | 4/2001 | Regueiro | F01L 1/34 123/90.15 |
| 7,669,566 | B2 | 3/2010 | Methley | |
| 2011/0162605 | A1 | 7/2011 | Wigsten | |

* cited by examiner

*Primary Examiner* — Zelalem Eshete

(57) ABSTRACT

A camshaft phaser including a gear arranged to receive torque from an engine, a housing non-rotatably connected to the gear and arranged to connect to a camshaft and a phase adjustment assembly including first gear teeth, second gear teeth and a hub arranged to non-rotatably connect to the camshaft and including third gear teeth and a displacement assembly arranged to for an advance mode, displace the hub in a first axial direction so that the third gear teeth non-rotatably connect to the second gear teeth and the hub is rotatable with respect to the housing in a first circumferential direction and for a retard mode, displace the hub in a second axial direction, opposite the first axial direction, so that the third gear teeth non-rotatably connect to the first gear teeth and the hub is rotatable with respect to the housing in a second circumferential direction.

20 Claims, 6 Drawing Sheets

MULTI-POSITIONAL CAMSHAFT PHASER WITH TWO ONE-WAY WEDGE CLUTCHES AND SPRING ACTUATOR

TECHNICAL FIELD

The present disclosure relates broadly to a multi-positional camshaft phaser with two one-way clutches. More particularly, the present disclosure relates to a camshaft phaser that utilizes an axially displaceable component and the inherent torque variability in the camshaft to engage and disengage the one-way clutches to enable the phaser to shift between a drive mode, an advance mode and a retard mode.

BACKGROUND

In order to improve engine performance, reduce emissions and increase fuel efficiency, it is known to equip internal combustion engines with mechanisms to vary the angle between the camshaft and the crankshaft. It is known to use fluid pressure in chambers created by respective portions of a drive gear/sprocket/stator and a rotor for a camshaft phaser to maintain and shift a rotational position of the rotor with respect to the stator. This known technique involves complicated hydraulic systems and controls. Typically, small engines used in recreational vehicle applications, for example, motorcycles, all-terrain vehicles (ATVs), and boats, often do not have the available oil pump capacity to drive a typical hydraulic variable cam phaser assembly (VCT). Typically, it is difficult to obtain the advantages of cam phasing without the need for hydraulic oil supply in smaller engines.

SUMMARY

According to aspects illustrated herein, there is provided a camshaft phaser including a gear arranged to receive torque from an engine, a housing non-rotatably connected to the gear and arranged to connect to a camshaft and a phase adjustment assembly including first gear teeth, second gear teeth and a hub arranged to non-rotatably connect to the camshaft and including third gear teeth and a displacement assembly arranged to for an advance mode, displace the hub in a first axial direction so that the third gear teeth non-rotatably connect to the second gear teeth and the hub is rotatable with respect to the housing in a first circumferential direction and for a retard mode, displace the hub in a second axial direction, opposite the first axial direction, so that the third gear teeth non-rotatably connect to the first gear teeth and the hub is rotatable with respect to the housing in a second circumferential direction opposite the first circumferential direction.

According to aspects illustrated herein, there is provided a camshaft phaser including a gear arranged to receive torque from an engine, a housing non-rotatably connected to the gear and arranged to connect to a camshaft, a phase adjustment assembly including an advance one-way clutch non-rotatably connected to the housing and including first gear teeth, a retard one-way clutch non-rotatably connected to the housing and including second gear teeth, and a hub arranged to non-rotatably connect to the camshaft and including third gear teeth and a displacement assembly arranged to for an advance mode, displace the hub in a first axial direction so that the third gear teeth non-rotatably connect to the second gear teeth and the hub is rotatable with respect to the housing in a first circumferential direction and for a retard mode, displace the hub in a second axial direction, opposite the first axial direction, so that the third gear teeth non-rotatably connect to the first gear teeth and the hub is rotatable with respect to the housing in a second circumferential direction, opposite the first circumferential direction.

According to aspects illustrated herein, there is provided a method of phasing a camshaft including the steps of receiving, using a gear non-rotatably connected to a housing, torque from an engine; for an advance mode, displacing first gear teeth non-rotatably connected to the camshaft in a first axial direction; non-rotatably connecting the first gear teeth with second gear teeth non-rotatably connected to the housing in a first circumferential direction; blocking, using the non-rotatable connection of the first and second gear teeth, rotation of the first gear teeth with respect to the housing, in the first circumferential direction; for a retard mode, displacing the first gear teeth in a second axial direction, opposite the first axial direction; non-rotatably connecting the first gear teeth to third gear teeth non-rotatably connected to the housing in a second circumferential direction, opposite the first circumferential direction; and, blocking, using the non-rotatable connection of the first and third gear teeth, rotation of the first gear teeth with respect to the housing, in the second circumferential direction.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. By "non-rotatably connected" components, we mean that the two components are connected so that whenever one of the components rotates the other component rotates and vice versa.

Figure 1:
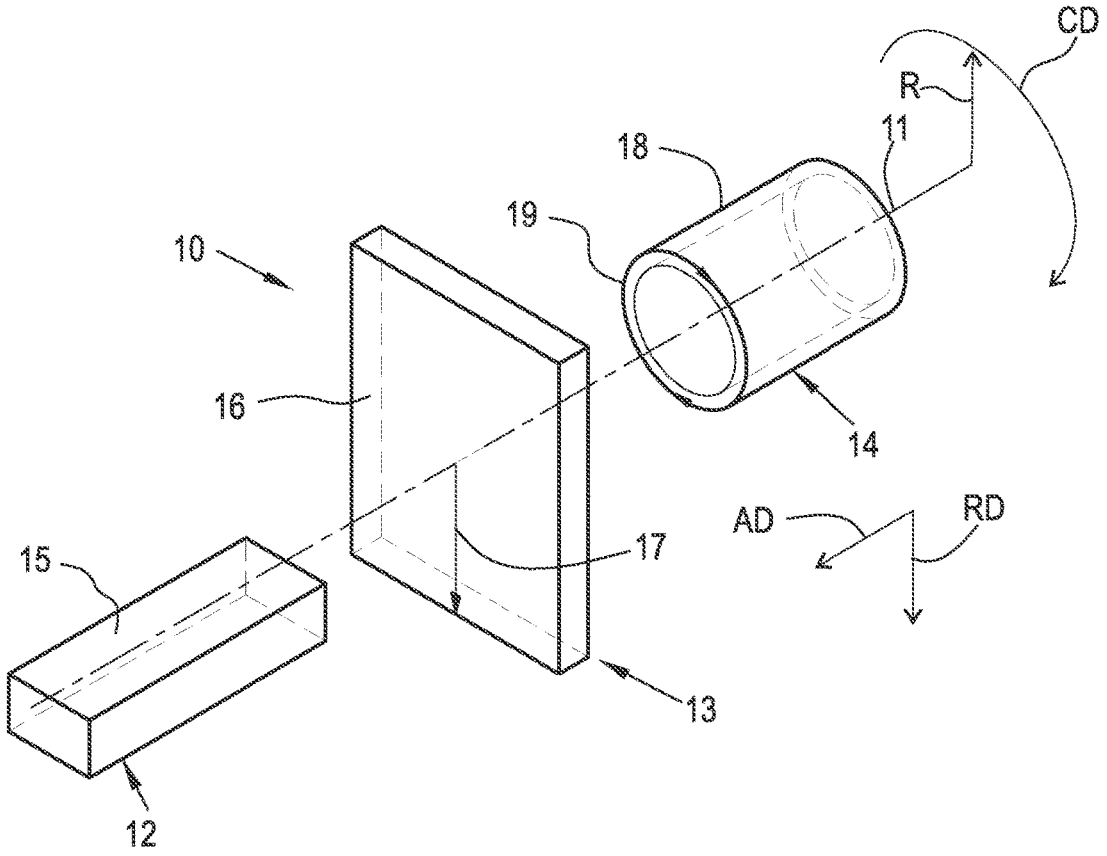
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane parallel to axis 11. Axis 11 is coplanar with planar surface 15; however it is not necessary for an axial surface to be coplanar with axis 11. A radial surface, such as surface 16 of object 13, is formed by a plane orthogonal to axis 11 and coplanar with a radius, for example, radius 17. Surface 18 of object 14 forms a circumferential, or cylindrical, surface. For example, circumference 19 forms a circle on surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively.

Figure 2:
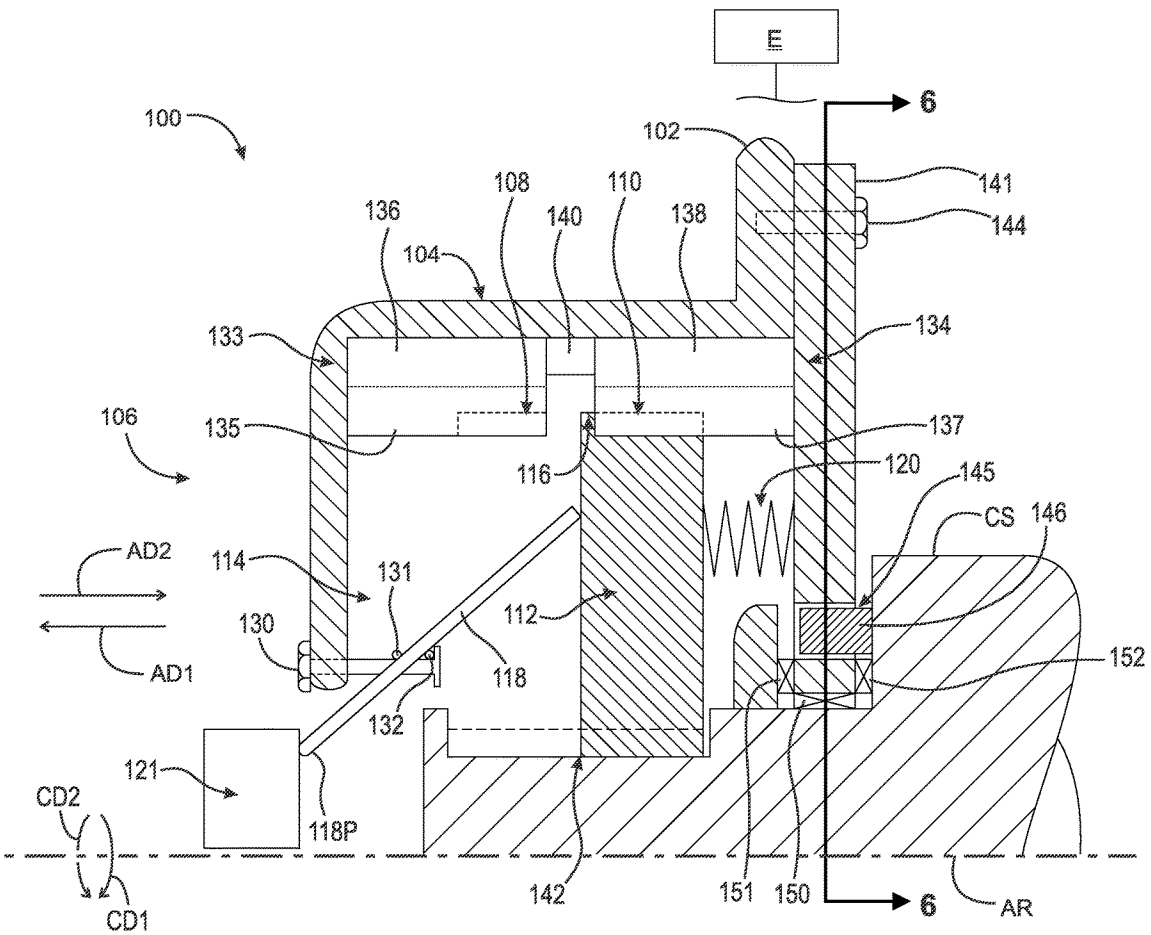
FIG. 2 is schematic partial cross-sectional view of a camshaft phaser with one-way dog clutches in a retard mode.

FIG. 2 is a schematic partial cross-sectional view of camshaft phaser 100 with two one-way clutches in a retard mode.

Figure 3:
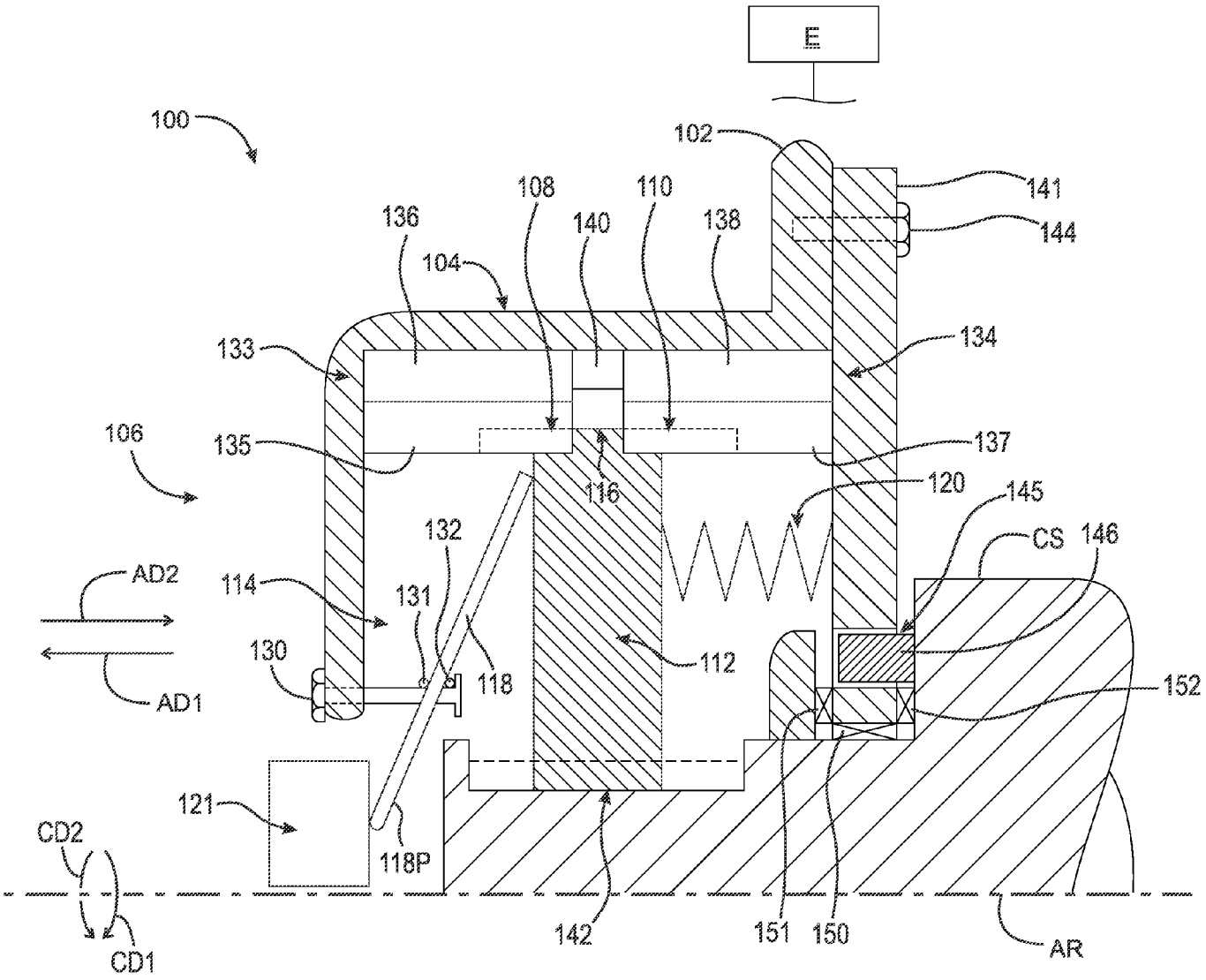
FIG. 3 is a schematic partial cross-sectional view of the camshaft phaser shown in FIG. 2 in a drive mode.

FIG. 3 is a schematic partial cross-sectional view of camshaft phaser 100 in FIG. 2 in a drive mode.

Figure 4:
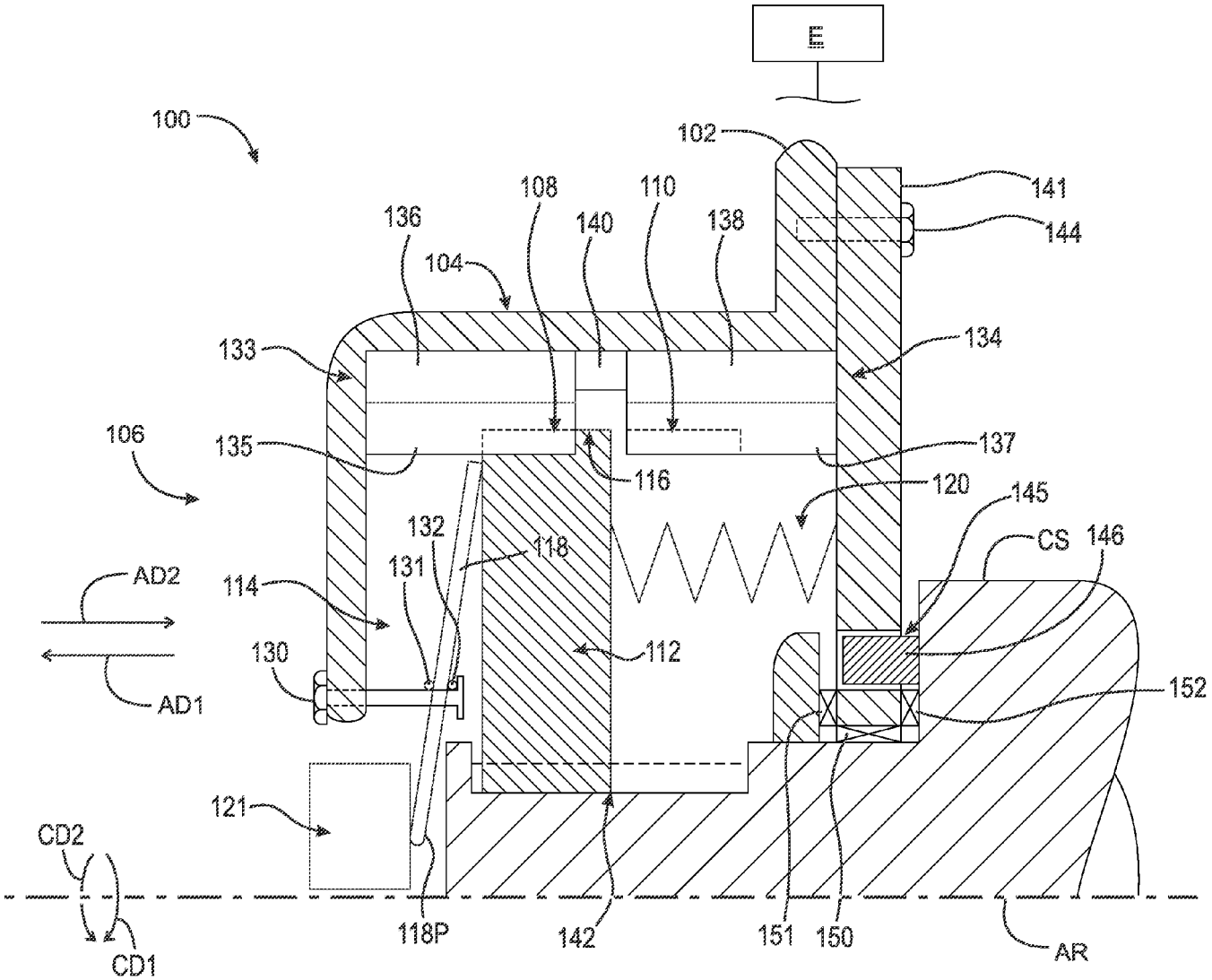
FIG. 4 is a schematic partial cross-sectional view of the camshaft phaser shown in FIG. 2 in an advance mode.

FIG. 4 is a schematic partial cross-sectional view of camshaft phaser 100 in FIG. 2 in an advance mode.

Figure 5:
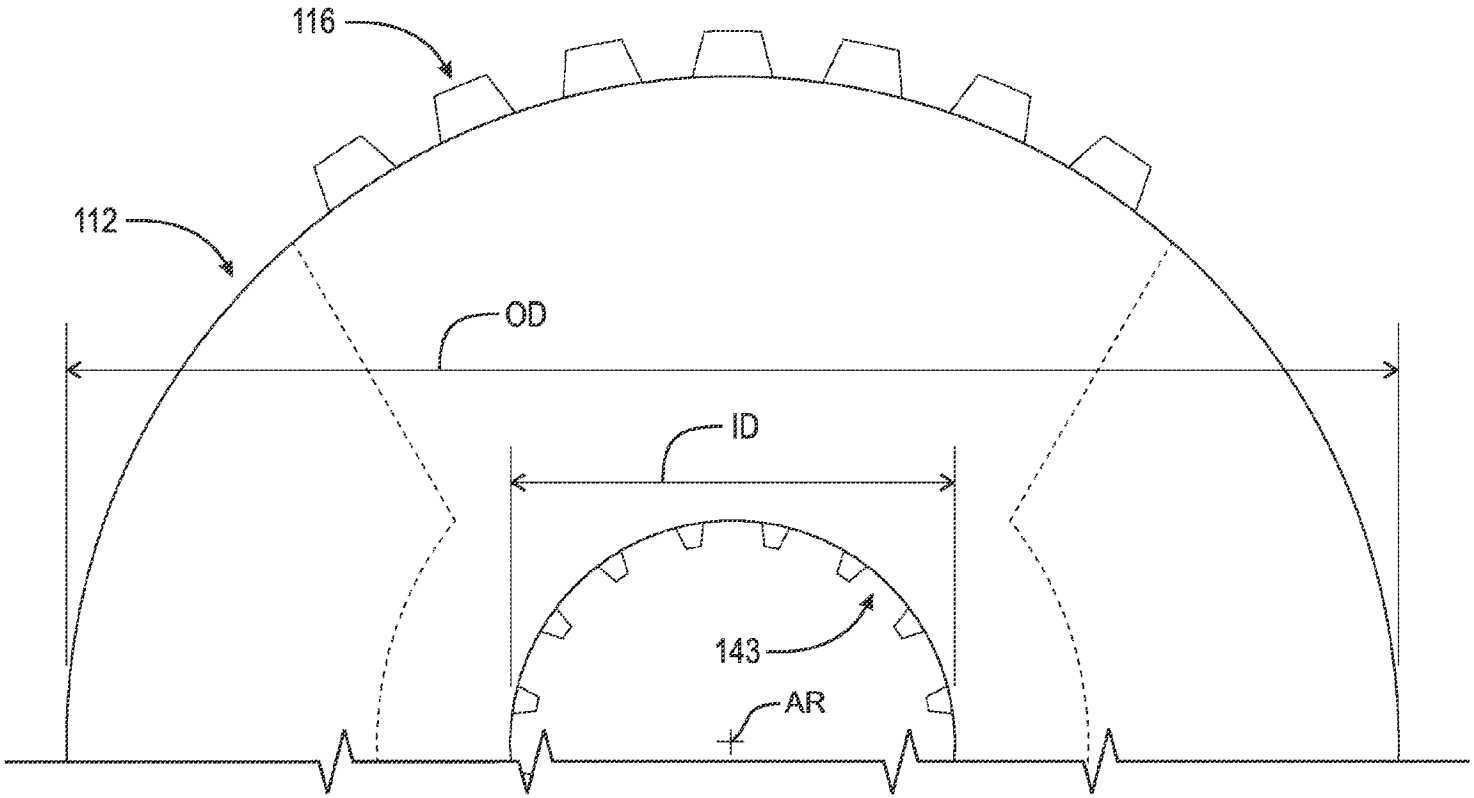
FIG. 5 is a schematic partial front view of the hub of the camshaft phaser shown in FIG. 2; and, FIG. 6 is a schematic partial cross-sectional view taken generally along line 6-6 in FIG. 2.
Figure 6:
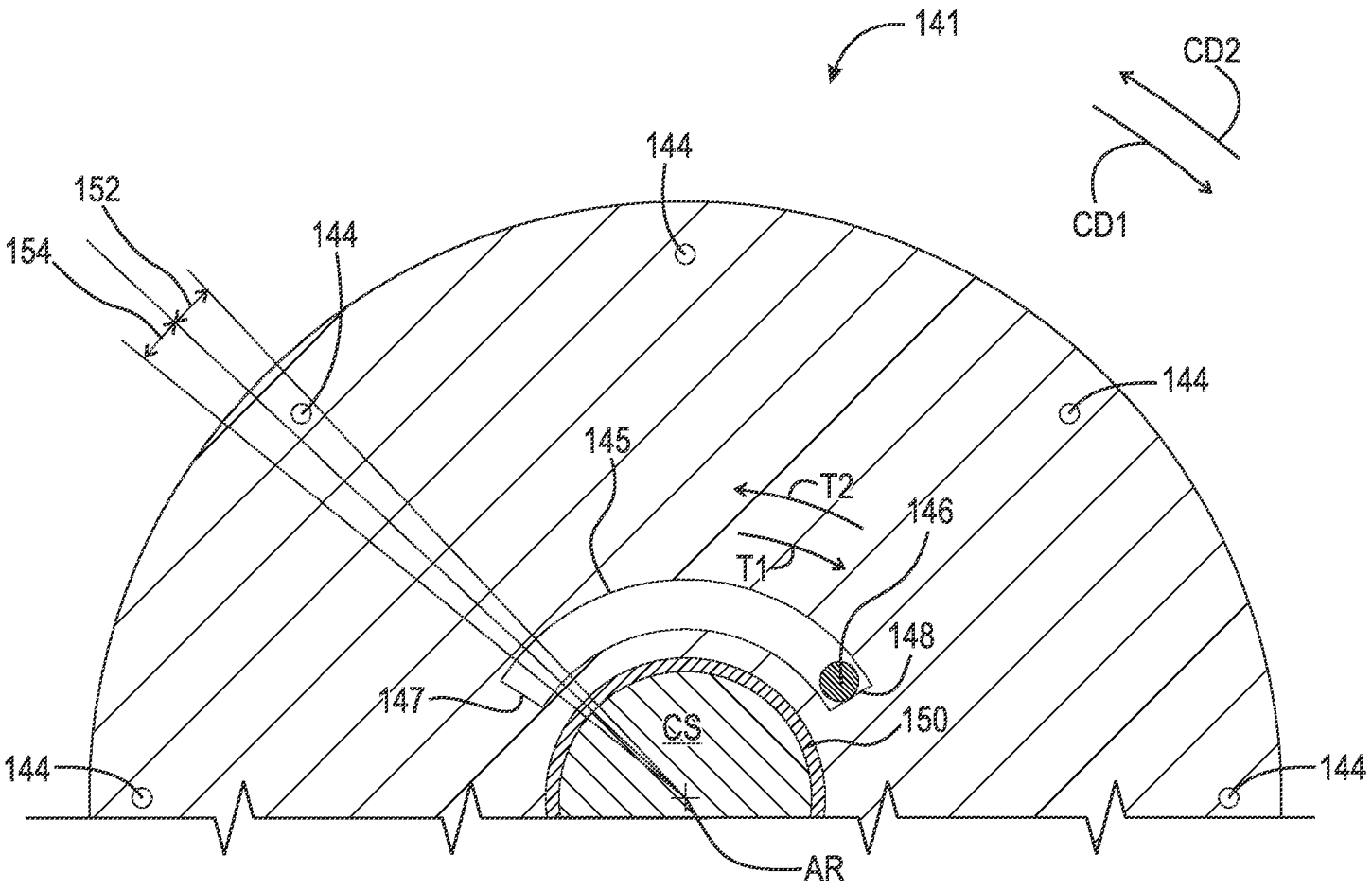

FIG. 5 is a schematic partial front view of the hub of the camshaft phaser shown in FIG. 2; and, FIG. 6 is a schematic partial cross-sectional view taken generally along line 6-6 in FIG. 2. The following should be viewed in light of FIGS. 2-6. Camshaft phaser 100 broadly includes gear 102, housing 104, and phase adjustment assembly 106. Camshaft phaser 100 is rotatable about axis of rotation AR. Gear 102 is arranged to receive torque from engine E. For the discussion that follows, it is assumed that gear 102 rotates and transmits torque in direction CD1. Housing 104 is non-rotatably connected to gear 102 and arranged to connect to camshaft CS. Phase adjustment assembly 106 broadly includes gear teeth 108, gear teeth 110, and displacement assembly 114. Displacement assembly 114 includes hub 112 arranged to non-rotatably connect to camshaft CS and having gear teeth 116. In an example embodiment, gear teeth 116 are non-rotatably connected to a radially outermost circumferential surface of hub 112.

For the advance mode, displacement assembly 114 is arranged to displace hub 112 in axial direction AD1 so that gear teeth 116 non-rotatably connect to gear teeth 108. In the advance mode, hub 112 and gear teeth 116 are rotatable with respect to housing 104 in circumferential direction CD1 and non-rotatable with respect to housing 104 in circumferential direction CD2.

For a retard mode, displacement assembly 114 is arranged to displace hub 112 in axial direction AD2, opposite axial direction AD1, so that gear teeth 116 non-rotatably connect to gear teeth 110. In the retard mode, hub 112 and gear teeth 116 are rotatable with respect to housing 104 in circumferential direction CD2 and non-rotatable with respect to housing 104 in circumferential direction CD1.

For the drive mode, displacement assembly 114 is arranged to displace hub 112 axially so that gear teeth 116 non-rotatably connect to gear teeth 108 and 110. In the drive mode, hub 112 and gear teeth 116 are non-rotatable with respect to housing 104 and torque is transmitted between gear 102 and camshaft CS. In the drive mode, the rotational position of camshaft CS with respect to gear 102 is fixed.

It should be understood, gear teeth 116 always rotate in the direction of rotation for gear 102, for example, circumferential direction CD1. In the advance mode, gear teeth 116 rotate faster than stator 102 and in the retard mode, gear teeth 116 rotate slower than stator 102.

In an example embodiment, displacement assembly 114 includes resilient element 118 and resilient element 120. Resilient element 120 constantly urges hub 112 in axial direction AD1 and resilient element 118 is arranged to displace hub 112 in axial direction AD2, opposite axial direction AD1, against the force applied by resilient element 120. Resilient element 120 can be any resilient element known in the art, including, but not limited to a coil spring so long as resilient element 120 constantly provides a force on hub 112 in axial direction AD1. Although only a single resilient element 120 is depicted in the figures, additional resilient elements 120 are contemplated if desired or necessary. Resilient element 118 can be any resilient element known in the art, including, but not limited to, a diaphragm spring or a wave spring so long as resilient element 118 displaces hub 112 in axial direction AD2, against the force applied by resilient element 120.

In an example embodiment, hub 112 and gear teeth 116 are embodied as a dog clutch however, any clutch having gear teeth known in the art is contemplated. Hub 112 and gear teeth 116 can be a unitary structure or separate components.

In an example embodiment, displacement assembly 114 includes actuator 121 which is movable in axial directions AD1 and AD2. Actuator 121 can be any actuator known in the art, including, but not limited to an electrical, hydraulic, or pneumatic actuator. To operate resilient element 118 as discussed above, actuator 121 contacts portion 118P of resilient element 118 and actuator 121 displaces resilient element 118 in axial directions AD1 and AD2, for example to the retard position (shown in FIG. 2). In the retard position shown in FIG. 2, resilient elements 118 and 120 urge hub 112 and gear teeth 116 into non-rotatable connection with gear teeth 110.

In an example embodiment, resilient element 118 is a diaphragm spring pivotably supported on housing 104. In an example embodiment, actuator 121 engages resilient element 118 and pivots resilient element 118 on component 130 via snap rings 131 and 132. In an example embodiment, component 130 is a pin. Pin 130 and rings 131 and 132 can be replaced with any suitable alternative components known in the art. In an example embodiment (not shown), component 130 is a rivet including pivot rings 131 and 132 to pivotably support resilient element 118 on housing 104.

To shift from retard mode (FIG. 2) to the drive mode shown in FIG. 3, actuator 121 engages resilient element 118 to displace resilient element 118 to a drive position (shown in FIG. 3) such that resilient element 120 urges gear teeth 116 into non-rotatable connection with gear teeth 108 and 110. In an example embodiment, to shift from retard mode to drive mode, actuator 121 is moved in axial direction AD2 to cause resilient element 118 to pivot and hub 112 and gear teeth 116 move in axial direction AD1 biased by resilient element 120.

To shift from drive mode (FIG. 3) to advance mode shown in FIG. 4, actuator 121 engages resilient element 118 to displace resilient element 118 to an advance position (shown in FIG. 4) such that resilient element 120 urges gear teeth 116 into non-rotatable connection with gear teeth 108. In an example embodiment, to shift from drive mode to advance mode, actuator 121 is moved in axial direction AD2 to cause resilient element 118 to pivot and resilient element 120 displaces hub 112 and gear teeth 116 in axial direction AD1.

In the position shown in FIG. 2, resilient element 118 urges hub 112 in axial direction AD2 with a force greater than the constant biasing force of resilient element 120. In the position shown in FIG. 3, resilient element 118 urges hub 112 in axial direction AD1 with a force less than the constant biasing force of resilient element 120. In the position shown in FIG. 4, resilient element 118 urges hub 112 in axial direction AD1 with a force even less than the force applied to obtain the position shown in FIG. 3. In other words, while resilient element 120 maintains a force on hub 112, to shift from retard position to drive position and/or to advance position, resilient element 118 is actuated to counter the force applied on hub 112 by resilient element 120. In the retard position shown in FIG. 2, resilient element 118 applies the greatest amount of force. In the advance position shown in FIG. 4, resilient element 118 applies the least amount of force due to actuator 121.

In an example embodiment, phase adjustment assembly 106 includes: one-way (advance) clutch 133 non-rotatably connected to housing 104 and including gear teeth 108; and one-way (retard) clutch 134 non-rotatably connected to housing 104 and including gear teeth 110. One-way clutches 133 and 134 can be any one-way clutches known in the art, including, but not limited to, roller one-way clutches and sprag one-way clutches. In an example embodiment, one-way clutch 133 includes inner race 135 including gear teeth 108 and outer race 136 non-rotatably connected to housing 104. In an example embodiment, one-way clutch 134 includes inner race 137 including gear teeth 110 and outer race 138 non-rotatably connected to housing 104.

In an example embodiment, one-way clutches 133 and 134 are axially fixed with respect to housing 104. For example, gear teeth 108 are spaced apart axially from gear teeth 110 via spacer 140. Spacer 140 can be any suitable spacer known in the art, including, but not limited to a snap ring so long as it blocks movement of one-way clutches 133 and 134 in axial directions AD2 and AD1, respectively. In an example embodiment, one-way clutches 133 and 134 can be axially retained by any other suitable method, such as, a press fit in housing 104 or laser welding and spacer 140 can be dispensed with.

In an example embodiment, hub 112 is splined to camshaft CS such that hub 112 is non-rotatable yet axially displaceable with respect to camshaft CS. Splined connection 142 non-rotatably connects hub 112 and camshaft CS. FIG. 5 shows grooves 143 of spline connection 142 arranged on inner diameter ID of hub 112. Grooves 143 are arranged to mate with splines arranged around camshaft CS.

In an example embodiment, gear teeth 116 do not extend along the entire circumference of outer diameter OD because the relative rotation of hub 112 with respect to housing 104 is limited (as discussed below). Since the relative rotation of hub 112 with respect to housing 104 is limited, gear teeth 116 need only be present on the portion(s) of hub 112 which radially align with gear teeth 108 and/or 110. In an example embodiment (not shown), gear teeth 116 extend along the entire circumference of outer diameter OD.

In an example embodiment, camshaft phaser assembly 100 includes cover 141 fixedly secured to housing 104, for example, via rivets 144 (one of which is shown in FIGS. 2, 3 and 4). In FIG. 6, a plurality of rivets is shown. In an example embodiment, cover 141 is supported on camshaft CS by radial bearing 150 and thrust bearings 151 and 152. Any suitable bearings known in the art may be used.

In an example embodiment, cover 141 includes opening 145 to accommodate protrusion 146 extending from camshaft CS. Although only a single opening 145 and a single protrusion 146 are depicted in the Figures, it should be understood that other numbers and configurations of recesses 145 and protrusions 146 are possible. For example, in the example embodiment shown in the Figures, an identical recess and protrusion are present on the radially opposite side of axis of rotation AR.

In the example embodiment shown, protrusion 146 extends from camshaft CS in axial direction AD2 toward the front of camshaft phaser 100. Protrusion 146 can be any suitable protrusion known in the art, including, but not limited to a pin. Protrusion 146 can be integrally formed with or separately connected to camshaft CS. Opening 145 includes end walls 147 and 148. Protrusion 146 is rotatable within opening 145 and end walls 147 and 148 act as stops to limit the rotational displacement of camshaft CS with respect to housing 104 and gear 102 in the advance and retard modes. Although protrusion 146 is shown extending from camshaft into recess 145 of cover 141, it should be understood that cover 141 could include a protrusion extending into a recess in camshaft CS. Cover 141 can be a stamped piece of material.

The interaction between recess 145 and protrusion 146 prevents excessive circumferential rotation of camshaft CS in relation to housing 104. Excessive circumferential rotation would lead to excessive phasing of camshaft CS and could lead to damage to the internal combustion engine or could also prevent camshaft phaser 100 from rotating in either circumferential direction CD1 or CD2. Additionally, in the event that a malfunction occurs within camshaft phaser 100. Protrusion 146 abutting against end wall 147 or end wall 148 would prevent excessive phasing of camshaft CS.

Phaser 100 is switchable between the advance, retard, and drive modes from any position of hub 112 between the full advance (pin 146 in contact with end wall 148) and the full retard (pin 146 in contact with end wall 147).

Although a particular configuration of components are shown in the Figures, it should be understood that other configurations are possible. For example, the advance one-way clutch could be between spacer 140 and cover 141, with the retard one-way clutch on the other side of spacer 140.

The following further describes the operation of phaser 100. In the discussion that follows, gear 102 receives torque from the engine in direction CD1. In the advance mode, the circumferential position of camshaft CS with respect to gear 102 and housing 104 is shifted in direction CD1. In the retard mode, the circumferential position of camshaft CS with respect to gear 102 and housing 104 is shifted in direction CD2.

As is known in the art, torsional forces T1 and T2 are transmitted from camshaft CS, in directions CD1 and CD2, respectively, to hub 112 during operation of phaser 100. The torsional force forces are due to interaction of cam lobes (not shown) on camshaft CS with various components of a valve train (not shown) of which camshaft CS is a part. Torsional forces T1 and T2 are transmitted in a repeating cycle. Housing 104 rotates in direction CD1 (due to torque from gear 102); however, torsional force T1 urges hub 112 in direction CD1 with respect to the housing and torsional force T2 urges hub 112 in direction CD2 with respect to the housing. During operation, housing 104, hub 112, and camshaft CS are always rotating in direction CD1. However, unchecked, torque T1 and T2 cause camshaft CS and hub 112 to speed up and slow down relative to gear 102.

In the advance mode, each iteration of force T1 causes relative rotation of camshaft CS, hub 112, and one-way clutch 133 by amount 152 with respect to housing 104, in direction CD1. Each iteration of force T2 urges hub 112 in direction CD2. However, one-way clutch 133 can only rotate in direction CD1. Therefore, rotation of hub 112 and camshaft CS in direction CD2 is blocked by one-way clutch 133. Thus, for every cycle of forces T1 and T2, camshaft CS rotates by amount 152 in direction CD1. Camshaft CS continues to rotate by amounts 152 in direction CD1 until pin 146 contacts end wall 148 or until phaser 100 switches to the drive or retard mode.

In the retard mode, each iteration of force T2 causes relative rotation of camshaft CS, hub 112, and one-way clutch 134 by amount 154 with respect to housing 104, in direction CD2. Each iteration of force T1 urges hub 112 in direction CD1. However, one-way clutch 134 can only rotate in direction CD2. Therefore, rotation of hub 112 and camshaft CS in direction CD1 is blocked by clutch 134. Thus, for every cycle of forces T1 and T2, camshaft CS rotates by amount 154 in direction CD1. Camshaft CS continues to rotate by amounts 154 in direction CD2 until pin 146 contacts end wall 147 or until phaser 100 switches to the drive or advance mode.

The following describes a method for phasing camshaft 100. Although the method is presented as a sequence of steps for clarity, no order should be inferred from the sequence unless explicitly stated. A first step receives, using a gear non-rotatably connected to a housing, torque from an engine. A second step, for an advance mode, displaces gear teeth non-rotatably connected to the camshaft in a first axial direction. A third step non-rotatably connects the first gear teeth with second gear teeth non-rotatably connected to the housing. A fourth step blocks, using the non-rotatable connection of the first and second gear teeth, rotation of the first gear teeth with respect to the housing, in a first circumferential direction. A fifth step, for a retard mode, displaces the first gear teeth in a second axial direction, opposite the first axial direction. A sixth step non-rotatably connects the first gear teeth to third gear teeth non-rotatably connected to the housing. A seventh step blocks, using the non-rotatable connection of the first and third gear teeth, rotation of the first gear teeth with respect to the housing, in a second circumferential direction, opposite the first circumferential direction.

In an example embodiment, axially displacing the first gear teeth in the first and second axial directions, respectively, includes axially displacing, in the first and second axial directions, respectively, a dog clutch component including the first gear teeth non-rotatably connected to the camshaft.

In an example embodiment, non-rotatably connecting the first gear teeth to the second and third gear teeth, respectively, includes non-rotatably connecting the first gear teeth to first and second one-way clutches, respectively. In an example embodiment, each of the first and second one-way clutches includes an inner race including the second and third gear teeth, respectively, and an outer race non-rotatably connected to the housing.

In an example embodiment, axially displacing the first gear teeth in the first and second axial directions, respectively, includes a first resilient element urging the first gear teeth in the first axial direction and a second resilient element urging the first gear teeth in the second axial direction, opposite the first axial direction.

Advantageously, phaser 100 and a method using phaser 100 provide a robust camshaft phasing without the use of hydraulic fluid in an engine including the camshaft. This is particularly advantageous for smaller engines for outboard motors, motorcycles, or all-terrain vehicles that have limited supplies of available hydraulic fluid. Many of these applications (e.g., outboard marine engines) could derive substantial benefit from having dual-position functionality (i.e., either fully advanced or fully retarded) without the need for continuous positioning control. In these cases, a drive mode as depicted in FIG. 3 would be optional.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A camshaft phaser, comprising:
- a gear arranged to receive torque from an engine;
- a housing non-rotatably connected to the gear and arranged to connect to a camshaft; and,
- a phase adjustment assembly including:
  - first gear teeth;
  - second gear teeth; and,
  - a hub arranged to non-rotatably connect to the camshaft and including third gear teeth; and,
  - a displacement assembly arranged to:
    - for an advance mode, displace the hub in a first axial direction so that:
      - the third gear teeth non-rotatably connect to the second gear teeth; and,
      - the hub is rotatable with respect to the housing in a first circumferential direction; and,
    - for a retard mode, displace the hub in a second axial direction, opposite the first axial direction, so that:
      - the third gear teeth non-rotatably connect to the first gear teeth; and,
      - the hub is rotatable with respect to the housing in a second circumferential direction opposite the first circumferential direction.

2. The camshaft phaser of claim 1, wherein:
- for the advance mode, the hub is non-rotatable with respect to the housing in the second circumferential direction; and,
- for the retard mode, the hub is non-rotatable with respect to the housing in the first circumferential direction.

3. The camshaft phaser of claim 1, wherein the displacement assembly is arranged to:

for a drive mode, displace the hub axially so that:

the third gear teeth non-rotatably connect to the first and second gear teeth; and, the hub is non-rotatable with respect to the housing.

4. The camshaft phaser of claim 3, wherein the displacement assembly includes:

a first resilient element urging the hub in the first axial direction;

a second resilient element urging the hub in the second axial direction; and, an actuator engaged with the second resilient element and arranged to:

displace a portion of the second resilient element to a first position such that the first resilient element urges the third gear teeth into non-rotatable connection with one of the first or second gear teeth;

displace the portion of the second resilient element to a second position such that the first and second resilient elements urge the third gear teeth into non-rotatable connection with the first and second gear teeth; and, displace the portion of the second resilient element to a third position such that the second resilient element urges the third gear teeth into non-rotatable connection with the other of the first or second gear teeth.

5. The camshaft phaser of claim 4, wherein:

the second resilient element urges the hub in the second axial direction with a first force;

in the first position, the first resilient element urges the hub in the first axial direction with a second force greater than the first force; and, in the second position, the first resilient element urges the hub in the first axial direction with a third force less than the second force.

6. The camshaft phaser of claim 1, wherein the displacement assembly includes:

a first resilient element urging the hub in the first axial direction; and, a second resilient element urging the hub in the second axial direction.

7. The camshaft phaser of claim 6, wherein the first resilient element is a diaphragm spring.

8. The camshaft phaser of claim 7, wherein the diaphragm spring is pivotably supported on the housing.

9. The camshaft phaser of claim 1, wherein:

the phase adjustment assembly includes first and second one-way clutches;

the first one-way clutch includes the first gear teeth; and, the second one-way clutch includes the second gear teeth.

10. The camshaft phaser of claim 9, wherein:

the first one-way clutch includes:

a first inner race including the first gear teeth; and, a first outer race non-rotatably connected to the housing; and, the second one-way clutch includes:

a second inner race including the second gear teeth; and, a second outer race non-rotatably connected to the housing.

11. A camshaft phaser, comprising:

a gear arranged to receive torque from an engine;

a housing non-rotatably connected to the gear and arranged to connect to a camshaft;

a phase adjustment assembly including:

an advance one-way clutch non-rotatably connected to the housing and including first gear teeth;

a retard one-way clutch non-rotatably connected to the housing and including second gear teeth; and, a hub arranged to non-rotatably connect to the camshaft and including third gear teeth; and, a displacement assembly arranged to:

for an advance mode, displace the hub in a first axial direction so that:

the third gear teeth non-rotatably connect to the second gear teeth; and, the hub is rotatable with respect to the housing in a first circumferential direction; and, for a retard mode, displace the hub in a second axial direction, opposite the first axial direction, so that:

the third gear teeth non-rotatably connect to the first gear teeth; and, the hub is rotatable with respect to the housing in a second circumferential direction, opposite the first circumferential direction.

12. The camshaft phaser of claim 11, wherein the displacement assembly is arranged to:

for a drive mode, displace the hub axially so that:

the third gear teeth non-rotatably connect to the first and second gear teeth; and, the hub is non-rotatable with respect to the housing.

13. The camshaft phaser of claim 11, wherein:

for the advance mode, the hub is non-rotatable with respect to the housing in the second circumferential direction; and, for the retard mode, the hub is non-rotatable with respect to the housing in the first circumferential direction.

14. The camshaft phaser of claim 12, wherein the displacement assembly includes:

a first resilient element urging the hub in the first axial direction;

a second resilient element urging the hub in the second axial direction; and, an actuator engaged with the second resilient element and arranged to:

displace a portion of the second resilient element to a first position such that the first resilient element urges the third gear teeth into non-rotatable connection with one of the first or second gear teeth;

displace the portion of the second resilient element to a second position such that the first and second resilient elements urge the third gear teeth into non-rotatable connection with the first and second gear teeth; and, displace the portion of the second resilient element to a third position such that the second resilient element urges the third gear teeth into non-rotatable connection with the other of the first or second gear teeth.

15. The camshaft phaser of claim 14, wherein:

the second resilient element urges the hub in the second axial direction with a first force;

in the first position, the first resilient element urges the hub in the first axial direction with a second force greater than the first force; and, in the second position, the first resilient element urges the hub in the first axial direction with a third force less than the second force.

16. The camshaft phaser of claim 14, wherein the first resilient element is a diaphragm spring.

17. The camshaft phaser of claim 16, wherein the diaphragm spring is pivotably supported on the housing.

18. The camshaft phaser of claim 14, wherein the second resilient element is a spring applying a constant force on the hub.

19. The camshaft phaser of claim 18, wherein the spring is supported on the housing.

20. A method of phasing a camshaft, comprising:

receiving, using a gear non-rotatably connected to a housing, torque from an engine;

for an advance mode, displacing first gear teeth non-rotatably connected to the camshaft in a first axial direction;

non-rotatably connecting the first gear teeth with second gear teeth non-rotatably connected to the housing in a first circumferential direction;

blocking, using the non-rotatable connection of the first and second gear teeth, rotation of the first gear teeth with respect to the housing, in the first circumferential direction;

for a retard mode, displacing the first gear teeth in a second axial direction, opposite the first axial direction;

non-rotatably connecting the first gear teeth to third gear teeth non-rotatably connected to the housing in a second circumferential direction, opposite the first circumferential direction; and, blocking, using the non-rotatable connection of the first and third gear teeth, rotation of the first gear teeth with respect to the housing, in the second circumferential direction.

* * * * *